United States Patent [19]

Boxell et al.

[11] Patent Number: 4,715,440

[45] Date of Patent: Dec. 29, 1987

[54] DOWNHOLE TOOLS

[75] Inventors: Timothy G. Boxell, Haslemere; Frank B. Bardsley, Andover; David E. Stoddart, Stroud, all of England

[73] Assignee: Gearhart Tesel Limited, Basingstoke, England

[21] Appl. No.: 885,241

[22] Filed: Jul. 14, 1986

[30] Foreign Application Priority Data

Jul. 25, 1985 [GB] United Kingdom ..... 8518823

[51] Int. Cl.[4] ..... E21B 47/00

[52] U.S. Cl. ..... 166/100; 166/250; 175/267

[58] Field of Search ..... 166/100, 250; 175/263, 175/266, 267, 269, 272, 284, 285

[56] References Cited

U.S. PATENT DOCUMENTS

| | | | |
|---|---|---|---|
| 1,667,155 | 4/1928 | Higdon | 175/263 |
| 4,002,063 | 1/1977 | Angehrn | 166/100 |

FOREIGN PATENT DOCUMENTS

| | | |
|---|---|---|
| 0102274 | 3/1984 | European Pat. Off. . |
| 1415447 | 11/1975 | United Kingdom . |
| 2052606 | 1/1981 | United Kingdom . |
| 2153413 | 8/1985 | United Kingdom . |

*Primary Examiner*—Stephen J. Novosad
*Assistant Examiner*—William P. Neuder
*Attorney, Agent, or Firm*—Hubbard, Thurman, Turner & Tucker

[57] ABSTRACT

A tool for use downhole has an elongate body, arms movably mounted on the body and means for controlling movement of the arms between an operational position and a retracted position. Movement of the arms is controlled by a motor and a transmission, according to one aspect of the invention the arms being suspended independently of one another and in a second aspect of the invention, movement of the arms being controllable remotely from the tool.

36 Claims, 8 Drawing Figures

DOWNHOLE TOOLS

BACKGROUND OF THE INVENTION

The invention relates to tools for use downhole, the tools being of the type comprising an elongate tool body and a plurality of arms or arm assemblies extending outwardly of the tool body carrying devices such as transducers for measuring characteristics of the surrounding material.

Being for use downhole, there are severe difficulties in designing tools of the above type and drive mechanisms for the arms or arm assemblies have been basic. Space has limited the number of arms or arm assemblies.

SUMMARY OF THE INVENTION

According to a first aspect of the invention, there is provided a tool for use downhole comprising an elongate body, a plurality of arm means movably mounted on the body, and means for controlling movement of the arm means between an operational position on which the arm means between an operational position on which the arm means extend outwardly with respect to the body and a retracted position, the arm means movement controlling means providing independent movement for each arm means.

According to a further aspect of the invention there is provided a tool for use downhole comprising an elongate body, a plurality of arm means movably mounted on the body, means for controlling movement of the arm means between an operational position in which the arm means extend outwardly with respect to the body and a retracted position, and means for controlling the resistance of the arm means to movement from the operational position towards the retracted position, said resistance controlling means being operable by an operator remote from the tool whereby adjustment of said arm means resistance can be carried out with the tool downhole.

The means for controlling movement of the arm means may comprise a motor and transmission means for translating the rotational drive of the motor into rectilinear movement for moving said arm means.

The motor may be located at one end of the elongate body. The motor is preferably within a motor module.

The transmission means may include a torque limiter for providing a limit on the torque transmitted through the transmission means.

The transmission means may include presser means movable rectilinearly in response to operation of the motor, and spring means acted on by said presser means, there being a spring means associated with each arm means, and each spring means exerting a force on the associated arm means dependent on the positions of the presser means and the arm means.

The transmission means may further comprise a shaft extending from the motor through the elongate body, the shaft having an externally threaded portion carrying an internally threaded block member, and means connecting the block member and the presser means, whereby rotation of the shaft by the motor causes the block member to move rectilinearly on the shaft, the rectilinear movement of the block member being transmitted to the presser means by the connecting means.

Potentiometer means are preferably provided to measure the displacement of the arm means relative to the elongate body.

Potentiometer means are preferably provided to measure the displacement between the presser means and the elongate body.

There may be a multiplicity of, and preferably six arm means.

Each arm means may comprise a parallelogram linkage comprising a pair of parallel arm elements pivotally mounted on the body, and a sensor carrying element extending between the arm elements at or adjacent free ends thereof.

Each arm means may be connected with the transmission means by a shearable, pivotal connection, preferably a shear pin. This has the advantage that if one or more arm means are put under pressure downhole, or if there is a blockage, or if electrical power to the motor is cut off, the tool can be brough to the surface merely by breaking the shearable connections to collapse the arms.

The transmission means are preferably maintained in oil at mud pressure, the tool preferably including a movable compensating piston movable in the tool body and with transmission oil in one side thereof and the other side thereof being exposed to material outside the tool. Movement of the compensating piston also provides for changes in internal displacement of the transmission means during movement of the arm means.

The arm means may carry different sensors, for example resistive, sonic, capacitive or inductive transducers.

Each sensor carrying element may be pivotally mounted on the associated arm for pivotal movement about an axis parallel to the axis of the elongate tool body.

The or each sensor carrying element may be mounted on the associated arm by means of pins on one of the pad and the arm pivotally engaging the other of the element and the arm. The pins are preferably mounted on the or each element and preferably engage bushes mounted on the associated arm.

The or each sensor carrying element may include one or more, preferably two scratcher elements lying proud of the outwardly facing surface of the element. The scratcher elements may be of tungsten carbide.

By way of example, one embodiment of a tool according to the invention will now be described with reference to the accompanying drawings, in which:

BRIEF DESCRIPTION OF THE DRAWINGS

FIG. 1 shows a general view of a downhole tool according to the invention. The tool has an elongate body 10 from which extend six arms 11 and at one end of which is located a motor module 12.

DESCRIPTION OF THE PREFERRED EMBODIMENT

Figure 1:
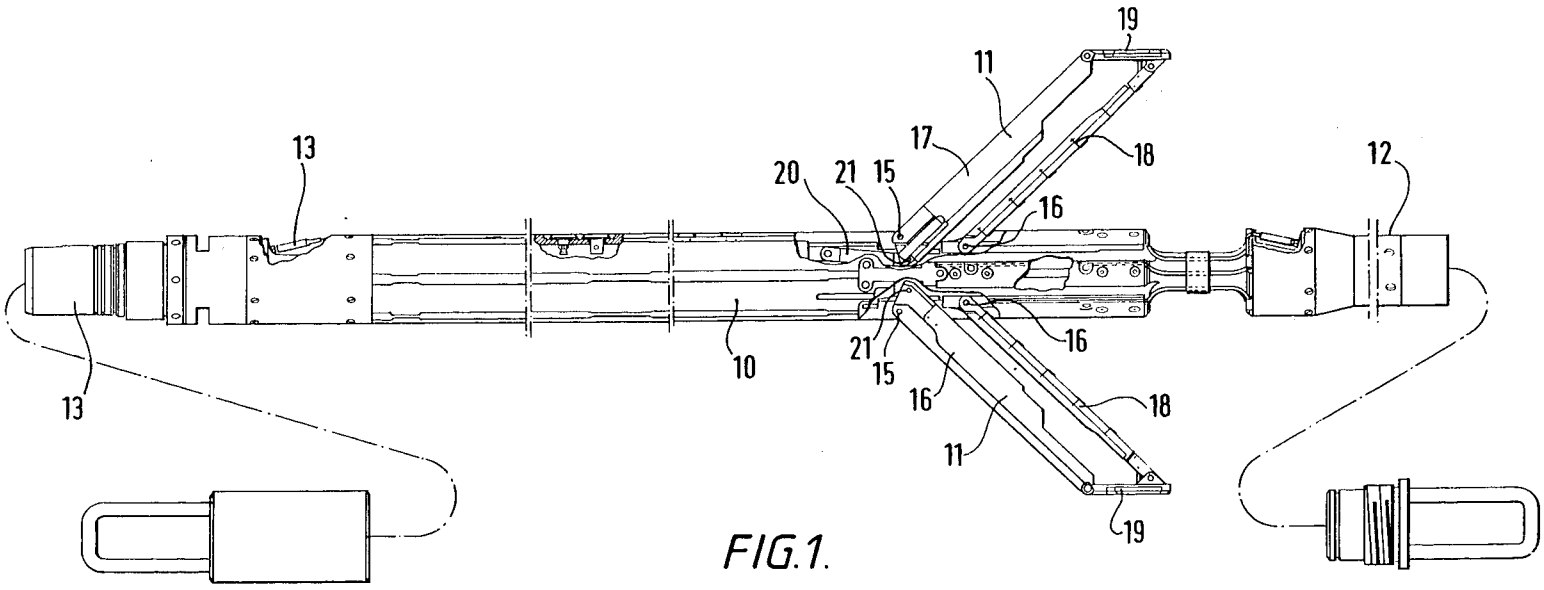
FIG. 1 is a general assembly drawing, partly cut away, of the tool.

At the end of the body 10 remote from the motor module 12, the tool carries a connector 13 for making electrical and mechanical connections between the tool and an adjacent component. Electrical connections are passed along the elongate body 10, one connection 14 being illustrated in a cut away portion of the body 10.

The six arms 11 are in the form of parallelogram linkages pivotally mounted on the elongate body 10 by bearings 15, 16. Each arm 11 has a first arm element 17 pivotally connected by the associated bearing 15 and a second arm element 18 pivotally connected by the associated bearing 16. Between the arm elements 17 and 18 of each arm 11 at their free ends is pivotally connected a sensor carrier 19. The sensor carrier 19 may carry a variety of different sensors, for example resistive, sonic, capacitive or inductive transducers.

The parallel linkage arrangement of the arms 11 allows the arms to be moved from a retracted position in which the arms lie along the elongate body 10 to an operative position as shown in FIG. 1 in which the arms 11 extend outwardly from the body. Movement of the arms 11 between a retracted position and an operative position is controlled by the motor in the motor module 12 via a transmission which will be described in detail with reference to FIGS. 2 to 6 of the drawings. The transmission causes movement of the arms 11 by means of links 20 pivotally connected at the end of the transmission and pivotally connected by means of shear pins 21 to an extension portion of the first arm element 17. The use of shear pins for the connections has the advantage that if there is a blockage downhole or if one or more arms are put under extreme pressure of if electrical power to the motor is cut off, the tool can be brought to the surface merely by breaking the shear pins 21 without further damage to the tool. Thus the tool is less likely than previous tools to be stuck downhole.

Figure 6:
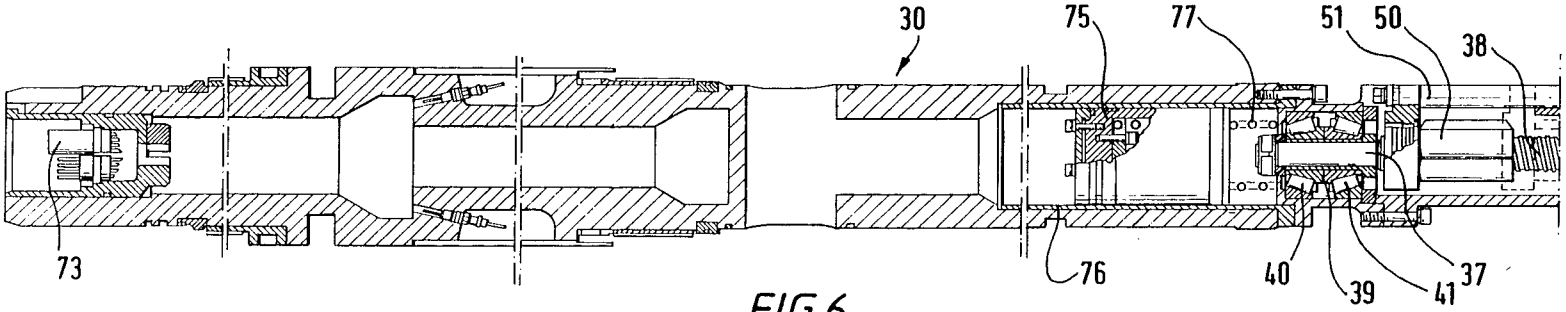
FIG. 6 is a part-sectional side view of the part of the internal chassis not shown in FIGS. 2 to 5.

FIGS. 2 to 5 illustrate part of internal chassis 30 of the tool, the remainder of the chassis 30 being illustrated in FIG. 6. The chassis 30 carries the transmission to transfer drive from the motor to the links 20 and operation of the transmission will be described starting from the motor end.

Figure 2:
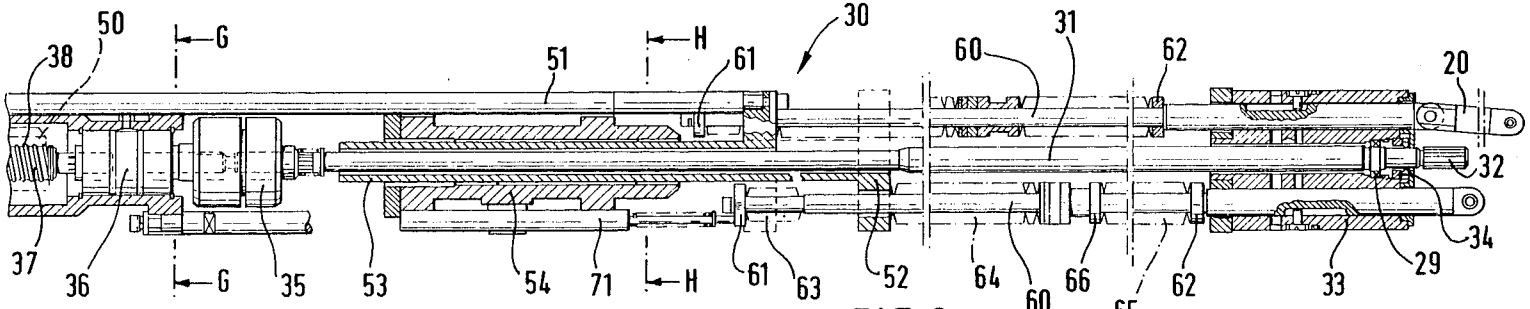
FIG. 2 is a part-sectional side view of an internal chassis portion of the tool of FIG. 1.
Figure 4:
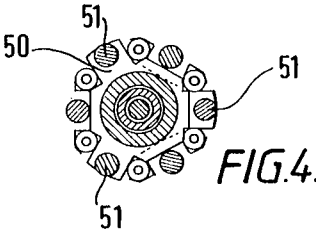
FIG. 4 is a sectional view along the lines H—H in FIG. 2.
Figure 3:
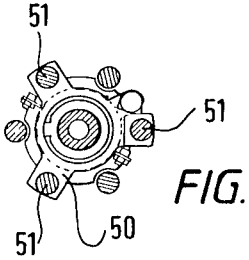
FIG. 3 is a sectional view along the lines G—G in FIG. 2.
Figure 5:
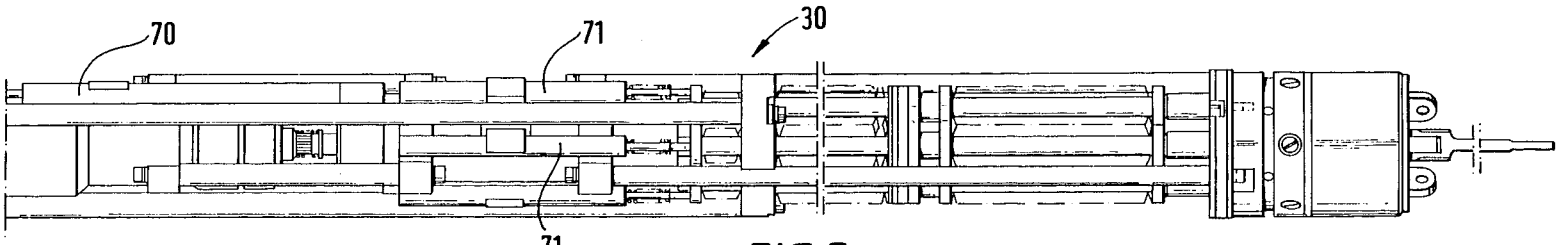
FIG. 5 is a plan view of the chassis portion of FIG. 2.

With reference to FIG. 2, a central shaft 31 passes along a significant extent of the chassis 30, the shaft 31 having a splined end 32 for connection to the motor.

As the shaft 31 enters the chassis at chassis block 33, the shaft passes through a rotary seal assembly 34 to ensure a seal between the interior of the tool and the outside.

The shaft 30 is connected to a torque limiter 35 which is in turn connected to a "no-back" bearing 36, the torque limiter 35 being to prevent transmission of torque above a certain limit beyond the shaft 31 and the no-back bearing 36 being to prevent any motion feedback to the ball screw 38.

From the no-back bearing 36 extends a rotary output shaft 37 carrying a ball screw 38, the free end of the output shaft 37 being mounted in a bearing assembly 39. The bearing assembly 39 has two opposed, angled tapered roller bearings 40, 41 to absorb any axial thrust along the output shaft 37.

The shaft 31 is supported in a bearing 29 in the chassis block 33.

The output shaft 37 carries an internally geared ball nut 50 shown in one position in solid lines in FIG. 6 and in an alternative position in FIG. 6 and FIG. 2 in chain lines. Rotation of the shaft 31 by the motor causes, via rotation of the torque limiter 35, the no -back bearing 36 and the output shaft 37, rectilinear movement of the ball nut 50. The ball nut 50 is in turn connected to three equiangularly spaced connecting rods 51 which in turn are connected to presser means in the form of a spider 52 shown in two alternative positions in FIG. 2. The spider 52 has a cylindrical portion 53 through which the shaft 31 extends and which portion 53 is located in shell bearings in a chassis element 54. Thus, rectilinear movement of the ball nut 50 causes equivalent rectilinear movement of the spider 52.

Through the spider 52 extend six plungers 60, each of which plungers 60 extends through the block 33 with an appropriate sealing arrangement and is connected to an associated link 20. The plungers 60 each have a first end stop 61 on one side of the spider 52 and a second end stop 62 on the other side of the spider 52. Each plunger 60 carries between the spider 52 and the first end stop 61 a first stack 63 of disc springs and between the spider and the second end stop 62 a second stack of disc springs divided into two sub-stacks 64, 65 for stability by a divider 66.

Thus, as the spider is urged towards the block 33, the spider exerts pressure on the spring sub-stacks 64 and 65 and hence pressure on the second end stop 62 and hence pressure on the links 20 to urge the arms outwardly towards the position shown in FIG. 1.

In this way, the arms 11 are all independently sprung and it is thus possible to have one arm 11 pushed inwardly by the surrounding material more than another arm 11. Likewise, if one shear pin 21 fails, there is no reason why the other arm should not operate satisfactorily.

When it is wished to retract the arms 11, the motor is operated to cause movement of the ball nut 50 away from the arms 11. The spider 52 is thus moved to reduce and then remove pressure on the spring sub-stacks 64, 65, Further operation of the motor causes the spider 52 to bear against the first spring stacks 63 to exert a force on the first end stop 62 of each plunger 60 to pull the arms 11 against the body 10.

The position of the ball nut 50 relative to the chassis of the tool is measured by a potentiometer 70 and the positions of the six plungers 60 relative to the chassis are measured by six potentiometers 71, one end of each potentiometer 71 being fixed relative to the chassis and the other end acting against the first end stop 61 of each plunger 60. The potentiometers 71 indicate the positions of each individual arm 11 and the information from the potentiometers 70 and 71 is transmitted electrically back to the surface via the wireline to which the tool is attached. In this way, a surface operator is given a picture of what is happening to the arms 11 and, if necessary, can reduce or increase the pressure of the arms against the borehole material by operating the motor 12 in the appropriate direction.

Electrical connections of the tool are made via an electrical connector 73 and transferred along the body of the tool from the connector 73 in known manner.

The tool transmission inside the outer skin of the tool is maintained in transmission fluid, for example a suitable oil, at external pressure, when downhole this being mud pressure. The balance between the transmission fluid pressure and the pressure outside the tool is maintained by a piston 75 sliding in a cylinder 76 in the tool chassis, a spring 77 acting between the piston 75 and the chassis. The motor 12 is in a sealed self-contained module in fluid not at the pressure of the transmission fluid.

Figure 7:
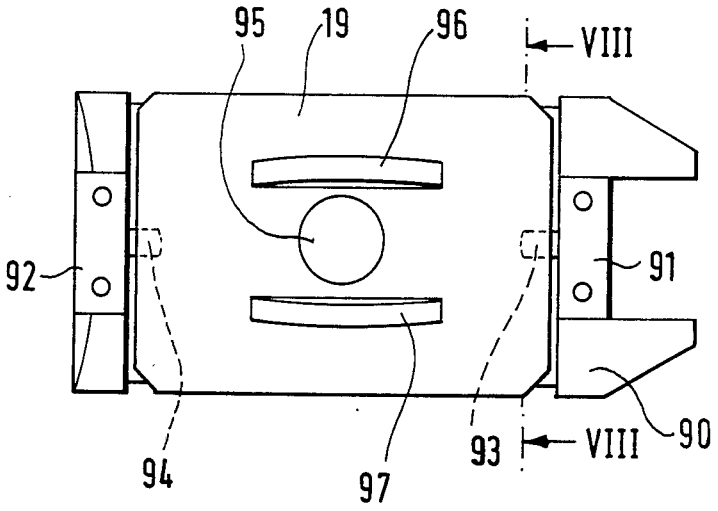
FIG. 7 is a plan view illustrating pivotal mounting of a sensor pad.
Figure 8:
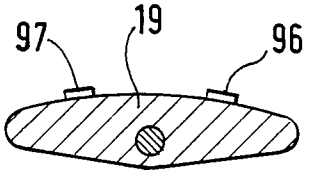
FIG. 8 is a sectional view along the lines VIII—VIII in FIG. 7 illustrating the sensor pad only.

FIGS. 7 and 8 illustrates the mounting of the sensor carrier or pad 19. Each arm 11 carries a mounting plate 90 which supports blocks 91, 92 including bushes (not shown). The sensor carrier 19 has pins 93, 94 extending outwardly therefrom to be received within the bushes to allow pivoting of the sensor carrier about an axis parallel to the longitudinal axis of the tool.

The sensor carrier 19 carries a sensor 95, and on either side of the sensor 95 are mounted scratcher elements 96, 97 of tungsten carbide (or other material of suitable hardness, abrasion resistance and resistance to hostile environments) designed to cut through material such as oil based muds used downhole.

The ability of the sensor carrier 19 to pivot allows additional adaptation to irregular contours and the presence of the scratcher elements improves contact characteristics, particularly when oil based muds are used.

This description makes reference to a specific embodiment and it will be appreciated that variations and alterations are possible within the scope of the invention defined by the appended claims.

The advantages of this embodiment of the tool according to the invention are that the transmission arrangement provides economy of space and allows six retractable arms to be used, that the arms are independently suspended so that an increase in resistance against one arm has no direct effect on the other arms, and that the outward pressure exerted by the sensor carrying arms can be controlled from the surface and does not have to be preset before the tool is sent downhole. The use of a torque limiter in the transmission limits the torque being transferred through the transmission and hence the maximum force capable of being applied to the arms. The pivotal mounting of the sensor carrier allows improved adaptation to irregular borehole contours and the scratcher elements are able to cut through material such as oil based muds.

What is claimed is:

1. A tool for use downhole comprising an elongate body, a plurality of arm means movably mounted on the body, and means for controlling movement of the arm means between an operational position in which the arm means extend outwardly with respect to the body and a retracted position, the arm means movement controlling means comprising a motor, presser means movable rectilinearly in response to operation of the motor and independent resilient means located between said presser means and each of said arm means for permitting independent movement of said arm means in response to force exerted on said arm means by surrounding material.

2. A tool as claimed in claim 1 including transmission means for translating rotational drive of the motor into rectilinear movement for moving said arm means.

3. A tool as claimed in claim 2 wherein the transmission means includes a torque limiter for providing a limit on the torque transmitted through the transmission means.

4. A tool as claimed in claim 2 wherein the transmission means further comprises a shaft extending from the motor through the elongate body, the shaft having an externally threaded portion carrying an internally threaded block member, and means connecting the block member and the presser means, whereby rotation of the shaft by the motor causes the block member to move rectilinearly on the shaft, the rectilinear movement of the block member being transmitted to the presser means by the connecting means.

5. A tool as claimed in claim 2 comprising potentiometer means for measuring the displacement between the presser means and the elongate body.

6. A tool as claimed in claim 2 wherein the transmission means are maintained in transmission fluid at external pressure.

7. A tool as claimed in claim 6 including a movable compensating piston movable in the tool body with transmission fluid on one side thereof and the other side thereof being exposed to material outside the tool.

8. A tool as claimed in claim 1 wherein the motor is located at one end of the elongate body.

9. A tool as claimed in claim 2 wherein each arm means is connected to the transmission means by a shearable, pivotal connection.

10. A tool as claimed in claim 9 wherein each shearable, pivotal connection is a shear pin.

11. A tool as claimed in claim 1 comprising potentiometer means for measuring the displacement of the arm means relative to the elongate body.

12. A tool as claimed in claim 1 comprising a multiplicity of arm means.

13. A tool as claimed in claim 12 comprising six arm means.

14. A tool as claimed in claim 1 wherein each arm means comprises a parallelogram linkage comprising a pair of parallel arm elements pivotally mounted on the body and a sensor carrying element extending between the arm elements at or adjacent the free ends thereof.

15. A tool as claimed in claim 14 wherein the arm means are capable of carrying different sensors.

16. A tool as claimed in claim 14 wherein each sensor carrying element is pivotally mounted on the associated arm for pivotal movement about an axis parallel to the axis of the elongate tool body.

17. A tool as claimed in claim 14 wherein each sensor carrying element includes one or more scratcher elements lying proud of the outwardly facing surface of the sensor carrying element.

18. A tool for use downhole comprising an elongate body, a plurality of arm means movable mounted on the body, means for controlling movement of the arm means between an operational position in which the arm means extend outwardly with respect to the body and a retracted position, and means for controlling the resistance of the arm means to movement from the operational position towards the retracted position, said resistance controlling means being operable by an operator remote from the tool whereby adjustment of said arm means resistance can be carried out with the tool downhole.

19. A tool as claimed in claim 18 wherein the means for controlling movement of the arm means comprises a motor and transmission means.

20. A tool as claimed in claim 19 wherein the transmission means translates rotational drive of the motor into rectilinear movement for moving said arm means.

21. A tool as claimed in claim 20 wherein the transmission includes a torque limiter for providing a limit on the torque transmitted through the transmission means.

22. A tool as claimed in claim 19 wherein the transmission means includes presser means movable rectilinearly in response to operation of the motor, and spring means acted on by said presser means, there being a spring means associated with each arm means, and each spring means exerting a force on the associated arm means dependent on the positions of the presser means and the arm means.

23. A tool as claimed in claim 22 wherein the transmission means further comprises a shaft extending from the motor through the elongate body, the shaft having an externally threaded portion carrying an internally threaded block member, and means connecting the block member and the presser means, whereby rotation of the shaft by the motor causes the block member to move rectilinearly on the shaft, the rectilinear movement of the block member being transmitted to the presser means by the connecting means.

24. A tool as claimed in claim 22 comprising potentiometer means for measuring the displacement between the presser means and the elongate body.

25. A tool as claimed in claim 19 wherein the transmission means are maintained in transmission fluid at external pressure.

26. A tool as claimed in claim 25 including a movable compensating piston movable in the tool body with transmission fluid on one side thereof and the other side thereof being exposed to material outside the tool.

27. A tool as claimed in claim 19 wherein the motor is located at one end of the elongate body.

28. A tool as claimed in claim 19 wherein each arm means is connected to the transmission means by a shearable, pivotal connection.

29. A tool as claimed in claim 28 wherein each shearable, pivotal connection is a shear pin.

30. A tool as claimed in claim 18 comprising potentiometer means for measuring the displacement of the arm means relative to the elongate body.

31. A tool as claimed in claim 18 comprising a multiplicity of arm means.

32. A tool as claimed in claim 31 comprising six arm means.

33. A tool as claimed in claim 18 wherein each arm means comprises a parallelogram linkage comprising a pair of parallel arm elements pivotally mounted on the body and a sensor carrying element extending between the arm elements at or adjacent the free ends thereof.

34. A tool as claimed in claim 33 wherein the arm means are capable of carrying different sensors.

35. A tool as claimed in claim 33 wherein each sensor carrying element is pivotally mounted on the associated arm for pivotal meovement about an axis parallel to the axis of the elongate tool body.

36. A tool as claimed in claim 33 wherein each sensor carrying element includes one or more scratcher elements lying proud of the outwardly facing surface of the sensor carrying element.

* * * * *